US009935404B2

(12) United States Patent
Zieder

(10) Patent No.: US 9,935,404 B2
(45) Date of Patent: Apr. 3, 2018

(54) CONNECTOR FOR SHIELDED ELECTRIC CABLES AND CORRESPONDING ASSEMBLY METHOD

(71) Applicant: Nicomatic SA, Bons en Chablais (FR)

(72) Inventor: David Zieder, Sciez (FR)

(73) Assignee: Nicomatic SA, Bons en Chablais (FR)

( * ) Notice: Subject to any disclaimer, the term of this patent is extended or adjusted under 35 U.S.C. 154(b) by 136 days.

(21) Appl. No.: 14/401,291

(22) PCT Filed: May 14, 2013

(86) PCT No.: PCT/EP2013/059965
§ 371 (c)(1),
(2) Date: Nov. 14, 2014

(87) PCT Pub. No.: WO2013/171230
PCT Pub. Date: Nov. 21, 2013

(65) Prior Publication Data

US 2015/0126067 A1 May 7, 2015

(30) Foreign Application Priority Data

May 16, 2012 (FR) ..... 1201414

(51) Int. Cl.
*H01R 9/03* (2006.01)
*H01R 13/6592* (2011.01)
(Continued)

(52) U.S. Cl.
CPC ..... *H01R 13/6592* (2013.01); *H01R 9/032* (2013.01); *H01R 9/0518* (2013.01); *H01R 12/594* (2013.01); *H01R 13/658* (2013.01)

(58) Field of Classification Search
CPC ..... H01R 13/6592; H01R 13/658; H01R 9/0518; H01R 9/032; H01R 12/594
(Continued)

(56) References Cited

U.S. PATENT DOCUMENTS 3,990,765 A * 11/1976 Hill ..... H01R 4/64 439/580
4,025,145 A * 5/1977 Shaffer ..... H01R 9/032 29/857
(Continued)

FOREIGN PATENT DOCUMENTS

GB 1 512 626 6/1978
JP 4-127624 11/1992
(Continued)

OTHER PUBLICATIONS

PCT Search Report of the ISA for PCT/EP2013/059965 dated Aug. 1, 2013; 7 pages.

*Primary Examiner* — Michael A Lyons
*Assistant Examiner* — Milagros Jeancharles
(74) *Attorney, Agent, or Firm* — Daly, Crowley, Mofford & Durkee, LLP

(57) ABSTRACT

The invention relates to a connector for a shielded electric cable (1), said shielded electric cable (3) comprising at least one conductor and a shielding (5) that at least partially covers said shielded electric cable (3), said connector (1) comprising a connector housing (7) containing the conductor, the invention being characterized in that said shielding (5) is partially arranged around said connector housing (7), said connector housing (7) being electroconductive, and said connector (1) comprising a holding ferule (11) arranged around the shielding (5) in such a way as to maintain the connection of the shielding (5) to the connector housing (7) both mechanically by means of clamping and also by direct electrical connection. The invention also relates to a method for the assembly of such a connector for a shielded electric cable.

19 Claims, 5 Drawing Sheets

Figure 1:
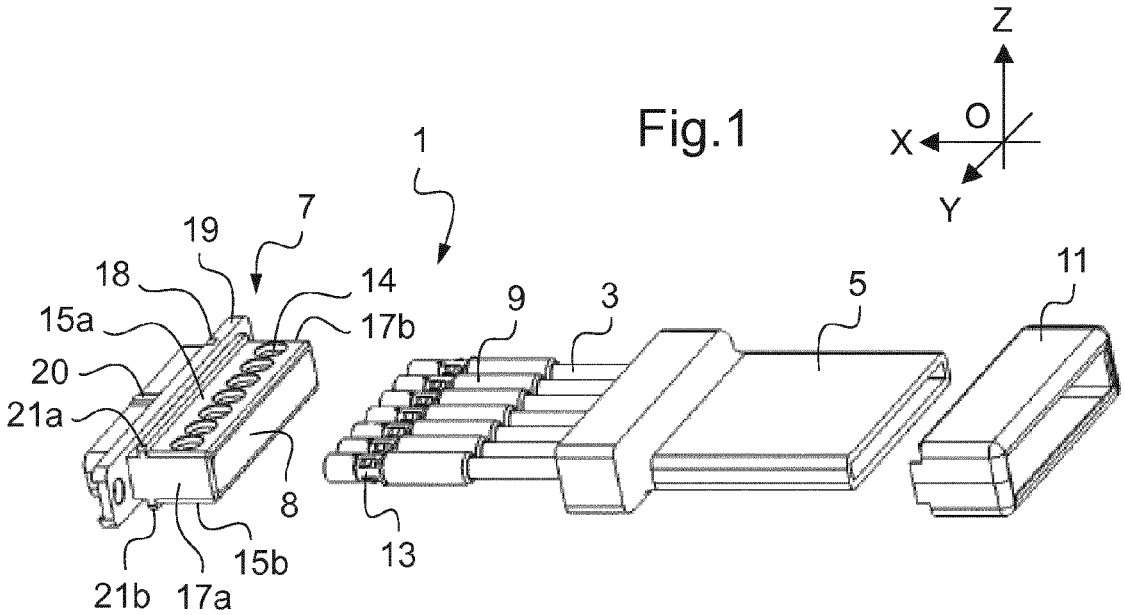

(51) Int. Cl.
*H01R 9/05* (2006.01)
*H01R 12/59* (2011.01)
*H01R 13/658* (2011.01)

(58) Field of Classification Search
USPC ..... 439/607.5, 607.12, 607.23, 607.27, 439/607.41, 607.45, 607.49, 607.55, 439/607.48, 497
See application file for complete search history.

(56) References Cited

U.S. PATENT DOCUMENTS 4,307,926 A * 12/1981 Smith ..... H01R 24/562 439/580
4,896,000 A * 1/1990 Procter ..... H01R 4/64 174/360
5,399,808 A * 3/1995 Carter ..... H01R 13/6592 174/36
5,571,992 A * 11/1996 Maleski ..... H01B 11/10 174/105 R
6,680,433 B2 * 1/2004 Hashizawa ..... H01R 13/521 174/359
7,173,182 B2 * 2/2007 Katsuyama ..... H01R 9/031 174/36
8,895,875 B2 * 11/2014 Kato ..... H02G 3/0462 174/359
9,112,287 B2 * 8/2015 Toyama ..... H01R 4/182
9,385,440 B2 * 7/2016 Nagahashi ..... H01R 4/203
2004/0144557 A1 * 7/2004 Miyazaki ..... H01R 13/6592 174/72 A
2005/0215122 A1 * 9/2005 Nishida ..... H01R 9/032 439/607.41
2013/0005182 A1 * 1/2013 Ratzlaff ..... H01R 9/032 439/607.01
2013/0316582 A1 * 11/2013 Imahori ..... H01R 4/10 439/607.55

FOREIGN PATENT DOCUMENTS

WO WO 2010/024633 A2 3/2010
WO WO 2011/096425 A1 8/2011

* cited by examiner

CONNECTOR FOR SHIELDED ELECTRIC CABLES AND CORRESPONDING ASSEMBLY METHOD

CROSS REFERENCE TO RELATED APPLICATIONS

This application is a U.S. National Stage of PCT application PCT/EP2013/059965 filed in the French language on May 14, 2013, and entitled "Connector For Shielded Electric Cables And Corresponding Assembly Method," which claims priority to French application FR1201414 filed May 16, 2012 which is incorporated herein by reference.

The present invention relates to a connector for shielded electric cables, and more particularly a connector for shielded electric cables making it possible to establish a direct electrical and mechanical connection between a shielding and an element of the connector ensuring the protection of the electric cable from electromagnetic interference using a holding ferrule.

The invention also relates to a method for assembling such a connector.

The shielding of an electric cable serves to proof the conductor, i.e. to protect it from surrounding electromagnetic disturbances, particularly those produced by neighboring cables or a neighboring electronics system, to preserve the integrity of the signals that pass through the conductor. Shielding also makes it possible to protect the neighboring cables or neighboring electronics system from the electromagnetic transmissions of the conductor. Shielding is particularly necessary in the aerospace field where protection from accidental signal faults is very desirable.

The ends of the cables are linked to connectors: the conductors of the cables are joined to conductors of the connector, for example electric plugs, and the shielding is set to a single and defined potential which is in practice the potential of the appliance or of the vehicle in which the electric cable is used. This implies a mechanical and electrical connection, also called a shield contact, of the shielding to an element of the connector in order to ensure electrical continuity between the shielding and the connector.

The conductor of the cable is often surrounded with one or more insulating sheaths, themselves surrounded by the shielding. The shielding can itself be surrounded by a protective sheath.

Thus, to establish the connection of the conductor of the cable with the conductor of the connector, it is necessary to strip the end thereof. This end is then no longer protected by the shielding.

Connectors of the prior art include tubular housings of circular or even rectangular cross section. The electric cables are inserted via a back end of the housings. The stripped ends of the conductors are then found in the front part of the housings.

In order to ensure the electromagnetic protection of the conductors over their whole length, the connectors of the prior art propose to form the shield contact by assembling the shielding aroused or inside a metallic backshell. This backshell can extend inside a connector housing and all the way to the stripped ends of the conductors, thus guaranteeing their electromagnetic protection.

In order to assemble the shielding on the backshell, several solutions exist including the soldering of the shielding onto the sleeve or the crimping of one or more holding ferrules around the shielding when the latter is wound around the backshell.

However, these assembly solutions are complex to implement. For example, connectors of the prior art often require the shielding to be cut or folded back in order to avoid short circuits with the conductors during the assembly. However, the shielding is a fragile element and is difficult to handle.

Moreover, connectors of the prior art often comprise a large number of elements in order to obtain on the one hand a reliable mechanical link between the shielding and the metallic sleeve, and on the other hand a reliable mechanical link between the metallic sleeve and the connector housing.

The aim of the invention is therefore to at least partly palliate the drawbacks of the prior art by providing a connector ensuring the electromagnetic protection of the electric cables by allowing a simplified electrical and mechanical connection between a shielding and an element of the connector.

For this purpose, the subject of the invention is a connector for a shielded electric cable, said shielded electric cable comprising at least one conductor and a shielding that at least partly covers said shielded electric cable, said connector comprising a connector housing in which the conductor is arranged, characterized in that said shielding is partly arranged around said connector housing, said connector housing being electrically conductive, and said connector comprising a holding ferrule arranged around said shielding so as to hold said shielding in mechanical connection by clamping and in direct electrical connection with the connector housing.

According to another aspect of the connector for a shielded electric cable, said holding ferrule has a back end applying a pressure to the shielding in the direction of the connector housing so as to allow a mechanical and electrical connection between the shielding and the connector housing over a first connection area over the whole perimeter of the connector housing.

According to another aspect of the connector for a shielded electric cable, said connector housing has positioning means and the holding ferrule has a front end, and the front end is folded hack against the positioning means, so as to form a second connection area allowing a mechanical connection between the holding ferrule and the connector housing.

According to another aspect of the connector for a shielded electric cable, the holding ferrule extends at least from the back face of the connector housing to the positioning means that it covers, thus forming two mechanical stops between the holding ferrule and the connector housing.

According to another aspect of the connector for a shielded electric cable, the holding ferrule is deformed in the direction of the connector housing, thus forming a third connection area allowing a mechanical and electrical connection between the shielding and the connector housing.

According to another aspect of the connector for a shielded electric cable, the connector housing has a first large face and a second large face, said first and second large faces having openings, characterized in that the holding ferrule is deep drawn in the direction of the connector housing at the level of the openings so that the shielding is partly drawn into the openings.

According to another aspect of the connector for a shielded electric cable, the connector has a substantially rectangular cross section.

According to another aspect of the connector for a shielded electric cable, the electric cable comprises a protective sheath arranged around the shielding, and the holding ferrule is arranged around the protective sheath so as to hold the protective sheath around the shielding around the outer surface of the connector housing so as to hold said shielding in mechanical connection by clamping and in direct electrical connection with the connector housing.

Another subject of the invention is a method for assembling a connector for a shielded electric cable, the shielded electric cable comprises at least one conductor and a shielding that at least partly covers the shielded electric cable, the connector comprises a connector housing and a holding ferrule having a back end and separate front ends, the method comprises the following steps:

- the electric shielding is wound around the connector housing,
- the holding ferrule is wound around the shielding so as to clamp the back end of the holding ferrule around the shielding and thus to clamp the shielding around the connector housing so as to form a first connection area, allowing an electrical and mechanical connection between the shielding and the connector housing,
- the front ends of the holding ferrule are crimped against the connector housing, so as to form a second connection area allowing a mechanical connection between the holding ferrule and the connector housing.

According to another aspect of the assembly method, the connector housing has positioning means, and the separate front ends are crimped against the positioning means.

According to another aspect of the assembly method, the method comprises the additional step wherein:

- the holding ferrule is deep drawn in the direction of the connector housing so as to form a third connection area, allowing an electrical and mechanical connection between the shielding and the connector housing.

According to another aspect of the assembly method, the connector housing has openings, and the holding ferrule is deep drawn into the openings so as to draw the shielding into the openings so as to form the third connection area.

Figure 2:
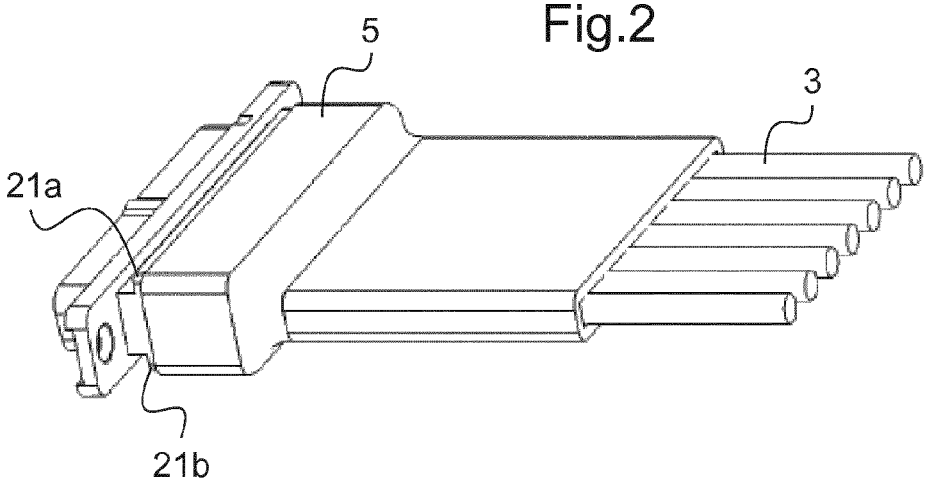
Figure 3:
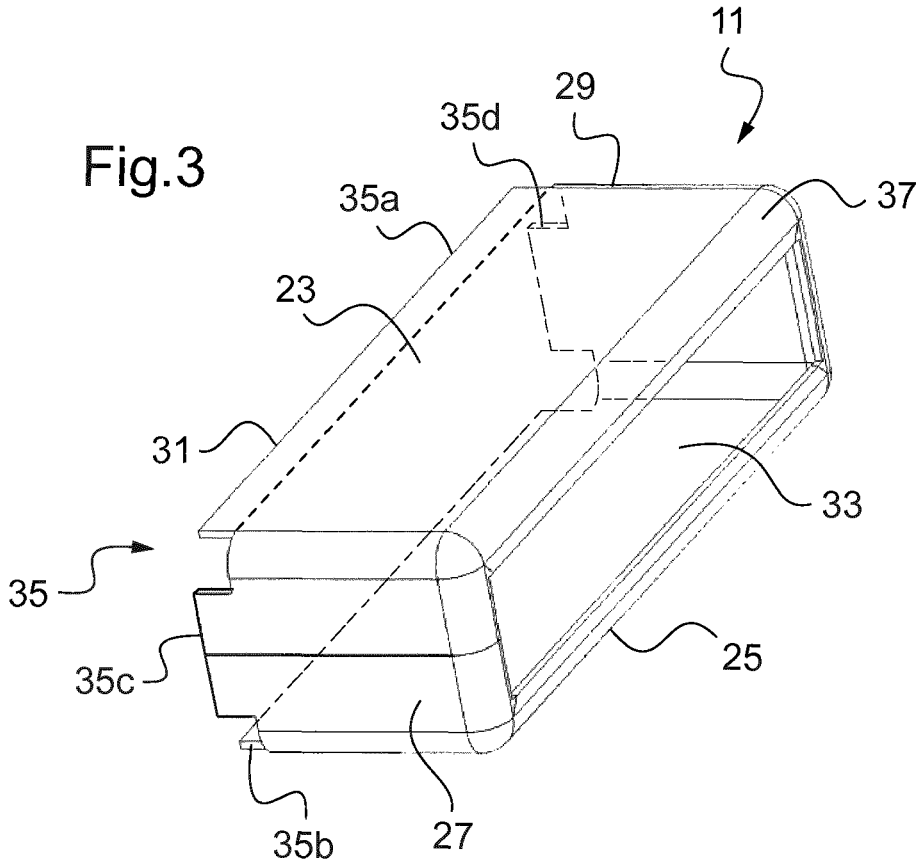
Figure 4:
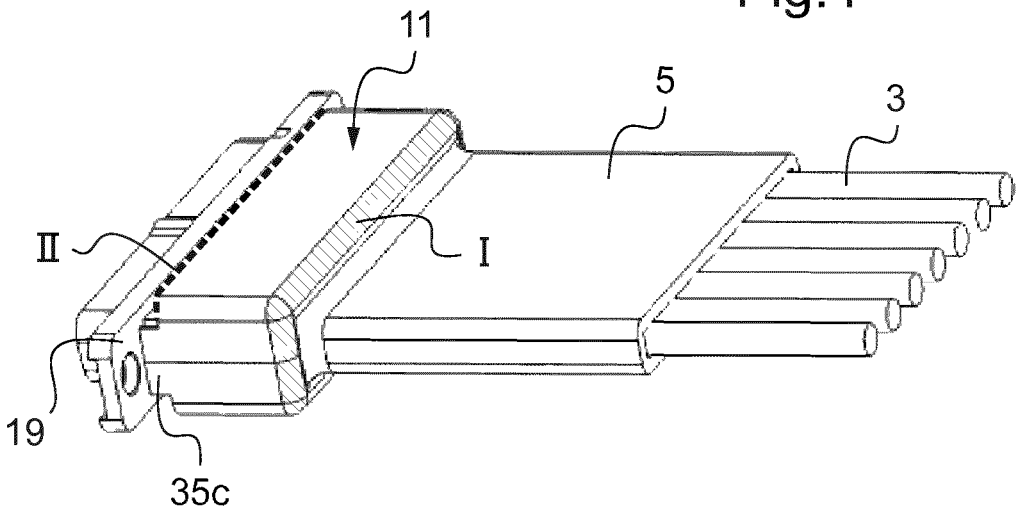
Figure 5:
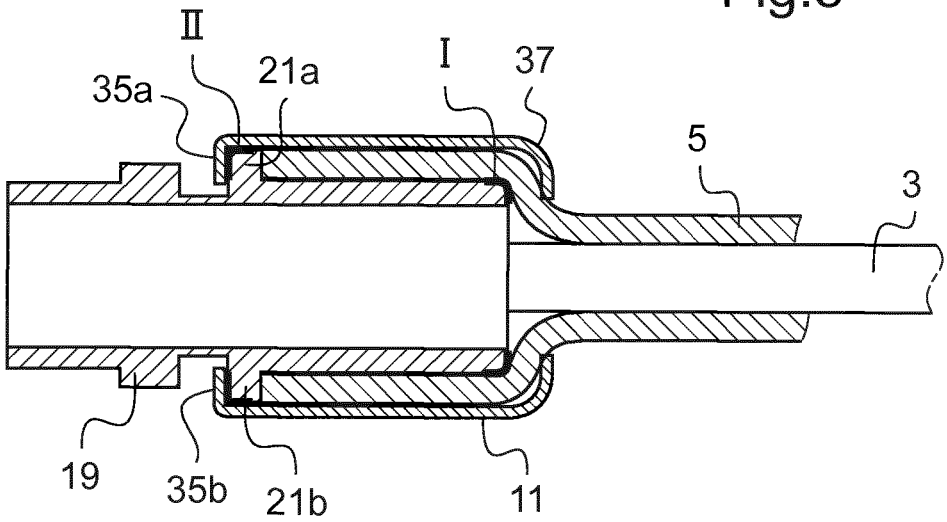
Figure 6:
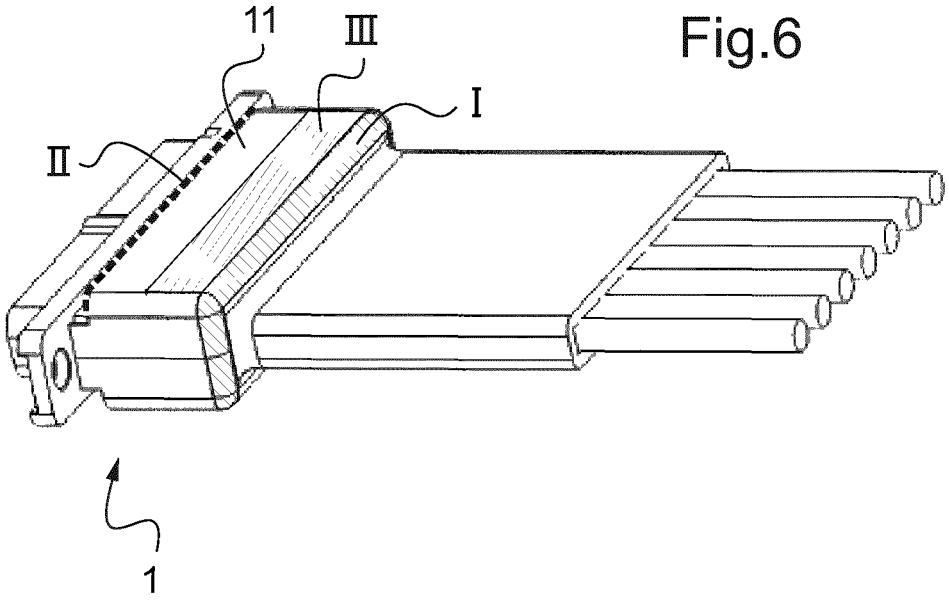
Figure 7:
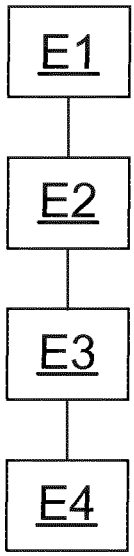
Figure 8:
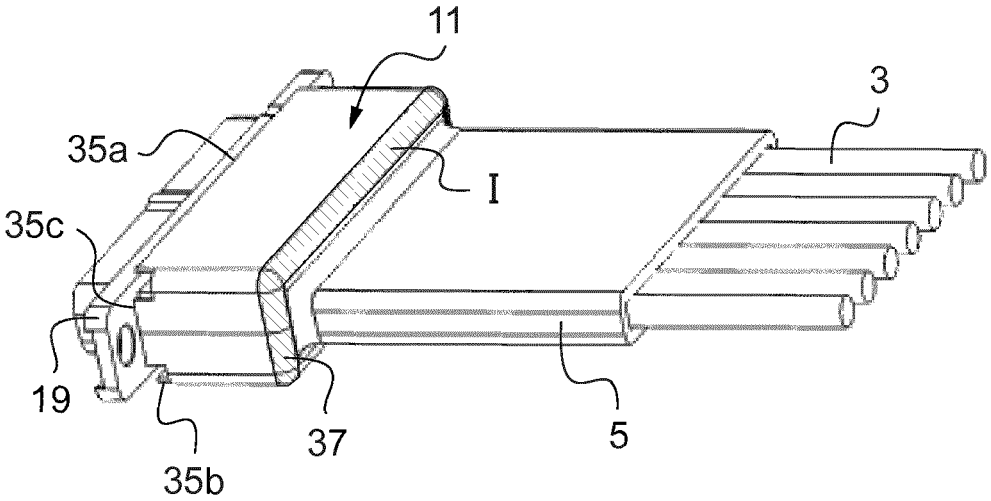
Figure 9:
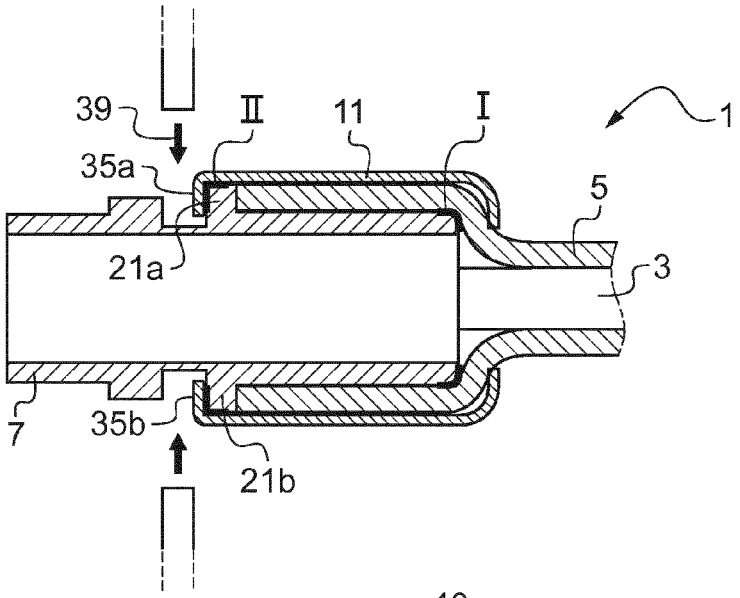
Figure 10A:
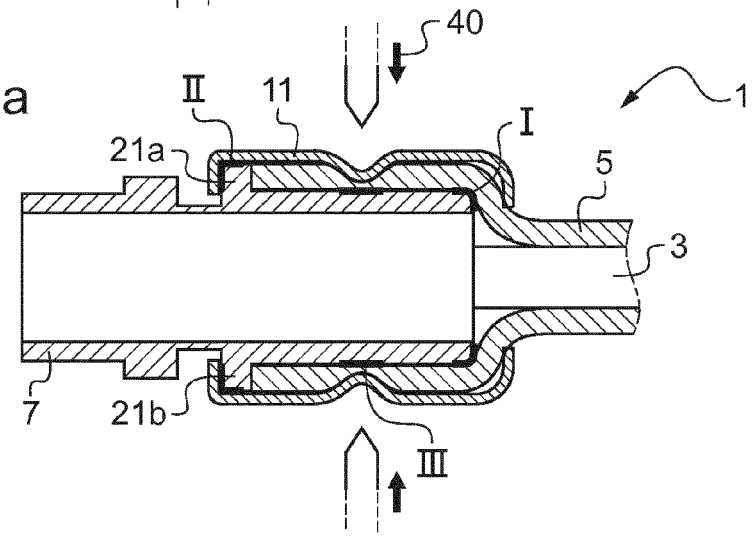
Figure 10B:
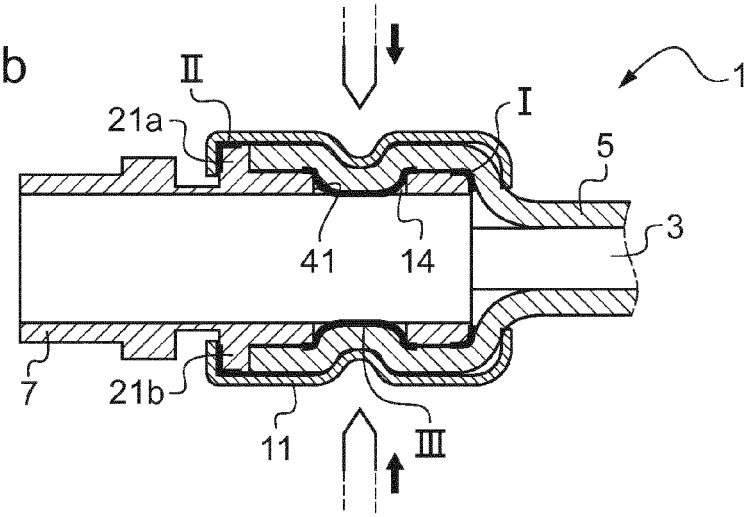

Other features and advantages of the invention will be highlighted in the following description, given by way of non-limiting example, with reference to the appended drawings wherein:

FIG. 1 represents an exploded view of the connector for shielded electric cables as well as the electric cables and their shielding, FIG. 2 represents a perspective view of a shielding arranged around a connector housing, FIG. 3 represents a perspective view of a holding ferrule, FIG. 4 represents a perspective view of a first connection area and a second connection area of the connector, FIG. 5 represents a section view of the first connection area and the second connection area of the connector, FIG. 6 represents a perspective view of the first connection area, the second connection area and a third connection area of the connector, FIG. 7 represents a schematic diagram of a method for fabricating the connector, FIG. 8 represents a perspective view of the holding ferrule wound around the shielding, itself wound around the connector housing, FIG. 9 represents a section view of a step of crimping the holding ferrule against the connector housing, FIG. 10*a* represents a section view of the connector showing the three connection areas, FIG. 10*b* represents a section view of the connector showing the first connection area, the second connection area and a variant of the third connection area.

In these drawings and in the remainder of the description, substantially identical elements are identified by the same reference numbers.

FIG. 1 represents an exploded and perspective view of the connector for shielded electric cables 1 and a plurality of electric cables 3.

An electric cable 3 generally comprises a central conductor, for example an electrical wire or a plurality of electrical filaments (not represented) through which an electrical signal passes. The conductor is often protected by one or more insulating sheaths making it possible to avoid short circuits with neighboring conductors.

In order to protect the electric cables 3 from electromagnetic disturbances in the environment, the cables are surrounded with a shielding 5. This shielding 5 can for example comprise a metallic braid.

A longitudinal axis X is defined along the length of the electric cable 3, a transverse axis Y along the width of the connector 1, and a vertical axis Z along the height (or thickness) of the connector 1. These three axes are substantially orthogonal and have the same origin O. These three axes X,Y,Z serve as reference for all the figures included in the text.

The connector 1 has a substantially rectangular cross section.

The connector 1 comprises a connector housing 7, at least one inner sleeve 9 for an electric cable 3 and a holding ferrule 11.

The connector housing 7 is electrically conductive. It can for example be made of metallic material.

The connector housing 7 has an open back face 8 by which at least one electric cable 3 is inserted into an inner sleeve 9. The connector housing 7 for example comprises a die (not shown) of insulating material making it possible to house the inner sleeve 9. The connector housing 7 can have a plurality of inner sleeves 9 each capable of housing an electric cable 3.

The inner sleeves 9 are for example made of insulating material, plastic for example.

The ends of the cables are stripped in order to make the conductors appear.

The die and the inner sleeves 9 make it possible to form an area of connection of the connector 1. For example, according to the shape of the die and the sleeves a male or a female connector will be manufactured.

The inner sleeves 9 constrain the movement of the electric cables 3 along the transverse axis Y and the vertical axis Z and thus prevent stripped ends of the conductors from coming in contact with each other and thus provoking short circuits.

The conductors are held inside the inner sleeves 9, for example by clipping on, crimping or adhesive bonding.

The connector housing 7 has a tubular shape of substantially rectangular cross section. The connector housing 7 has four faces comprising a first and a second large face 15*a*, 15*b* which are parallel with each other, linked by a first and a second small face 17*a*, 17*b* that are parallel with each other. The four faces 15*a*, 15*b*, 17*a*, 17*b* have an outer surface.

The outer surface of the connector housing 7 has a positioning means 21*a*, 21*b*, making it possible to position the shielding 5 around the connector housing 7.

The positioning means comprises for example an upper rib 21*a* extending over the width of the first large face of the housing 15*a*, and a lower rib part 21*b* extending over the width of the second large face of the housing 15*b*.

FIG. 2 represents the shielding 5 assembled around the connector housing 7. The shielding 5 sheath is wound via the back of the connector housing 7 and rests in abutment on the positioning means 21*a*, 21*b*.

Returning to FIG. 1, advantageously the first large face 15*a* and the second large face 15*b* can have a plurality of openings 14 distributed transversely. These openings 14 are for example through openings obtained by punching or milling of the connector housing 7. These openings 14 make it possible to improve the electrical continuity between the shielding 5 and the connector housing 7 as explained in the remainder of the description.

The outer surface of the connector housing 7 has fastening means 19, making it possible to fasten the connector housing 7 with a mating connector housing not represented) and thus to establish a mechanical connection between the connector housing and the mating connector housing.

These fastening means 19 comprise, for example, a front rib extending over the outer surface of the connector housing 7 around a transverse section, substantially to the front of the connector housing 7. The front rib can for example have openings allowing the passage of screws. Thus, the connector housing 7 and the mating connector housing can be assembled using screws and nuts.

The connector housing 7 can furthermore comprise aligning means 18 allowing alignment between the connector housing and the mating connector housing and therefore the guarantee of a good mechanical and electrical connection between them.

These aligning means 18 can for example comprise ribs or moves on the connector housing 7, the mating connector housing bearing the complementary ribs or grooves.

The connector housing 7 can furthermore have a polarization key 20, in order to ensure its assembly with the desired mating conductor housing, the mating conductor housing having a complementary polarization key.

The connector 1 also comprises a holding ferrule 11 as represented by FIG. 3.

The holding ferrule 11 has a tubular shape of rectangular cross section and comprises a first large ferrule face 23 parallel with a second large ferrule face 25. The two large ferrule faces 23, 25 are linked by a first small ferrule face 27 and a second small ferrule face 29. All the faces of the ferrule 23, 25, 27, 29 have a substantially rectangular shape.

The holding ferrule 11 also has a front opening 31 and a back opening 33, both having a substantially rectangular shape.

The holding ferrule 11 is for example obtained by determining a metallic sheet, of stainless steel for example.

The holding ferule 11 has a front end 35 and a back end 37 along the longitudinal axis X.

The front end 35 has four separate end parts 35*a*, 35*b*, 35*c*, 35*d* delimited by dotted lines and issuing respectively from the four ferrule faces 23, 25, 27 and 29. These four separate end parts 35*a*, 35*b*, 35*c*, 35*d* are for example obtained by cutting the corners of the front end 35 of the holding ferrule 11.

The back end 37 is folded back toward the inside of the holding ferrule 11, substantially perpendicular to the ferrule faces 23, 25, 27, 29. The size of the hack opening 33 is therefore reduced with respect to the size of the front opening 31. Moreover, the size of the hack opening 33 is less than the size of the back face 8 of the connector housing 7.

In this way, the back end 37 of the holding ferrule 11, arranged around the connector housing 7, applies a pressure to the shielding 5 sheath in the direction of the connector housing 7. With reference to FIG. 4, this pressure is distributed over the perimeter of the shielding 5 sheath and allows a connection between the shielding 5 and the connector housing 7 over a connection area I, called first connection area I. The connection established using the holding ferrule 11 between the shielding 5 and the connector housing 7 is a shield contact.

Indeed, the first connection area I allows a mechanical connection making it possible to firmly hold the shielding 5 sheath around the connector housing 7 when the connector 1 is subject to outside stresses. Thus, the protection against electromagnetic interference is still ensured when the connector is subject to shocks and/or vibrations.

This first contact area I also allows an electrical connection between the shielding 5 and the connector housing 7 over the whole perimeter of the connector 1, thereby ensuring electrical continuity between the shielding 5 and the connector 1. The connector housing 7 being metallic and covering the stripped ends of the conductor, it ensures their electromagnetic protection itself.

Thus, the connector 1 improves the electromagnetic protection with respect to the prior art. Specifically, by directly connecting the shielding 5 to the element ensuring protection from electromagnetic disturbances rather than to an intermediate element the risks of loss of electrical continuity are reduced.

Moreover, by reducing the number of elements required for the protection from electromagnetic disturbances the connector 1 is simplified and its size reduced.

The holding ferrule 11 extends at least from the back face 8 of the connector housing 7 to the positioning means 21*a*, 21*b* that it covers, thus forming two mechanical stops between the holding ferrule 11 and the connector housing 7.

Two of the separate end parts 35*a*, 35*b* of the holding ferrule 11 are crimped against the upper rib 21*a* and the lower rib 21*b* respectively.

In this way, a second connection is established at the level of a connection area II, called second connection area II. This second connection is a mechanical connection between the holding ferrule 11 and the connector housing 7.

Advantageously, provision can be made for the ferrule end parts that are not crimped 35*c*, 35*d* to rest in abutment with the fastening means 19. Thus, during the crimping step, the movement of the holding ferrule 11 is constrained along the longitudinal axis X. The crimping of the holding ferrule 11 is thus made easier and the efficiency of the connector 1 is improved as a consequence.

FIG. 5 represents a schematic section view of the connector 1 along the longitudinal axis X. In this FIG. 5, the first connection area I and the second connection area II can be seen. It will be understood that using the second connection, the holding ferrule 11 protects the shielding 5 around the connector housing 7 over its whole length. Thus, the shielding 5 is not subjected to outer stresses that could damage it. For example, in the case of a shielding braid, the end of the braid subjected to an environmental stress could come loose in the course of time.

In a first embodiment represented by FIG. 6, the large ferrule faces 23, 25 are deformed in the direction of the connector housing 7 at the level of a connection area III situated between the first connection area I and the second connection area II, called third connection area III.

This third contact area III makes it possible to establish an electrical connection and a mechanical connection between the connector housing 7 and the shielding 5 and thus improves the shield contact.

In the variant where the first housing face 15*a* and the second housing face 15*b* have openings 14, the third connection area III is situated at the level of the openings 14. As a reminder, the electric cables 3 are protected by the inner sleeves 9 and are therefore not damaged by the deformation.

Thus the shielding 5 is drawn into the openings 14. The pressure exerted by the holding ferrule 11 on the shielding 5 at the level of the edge of the openings 14 is greater than the pressure exerted over a planar surface. Consequently, the electrical and mechanical connection is farther improved.

According to another embodiment, the connector 1 has only the first connection area I and the second connection area II.

In one variant (not represented) of the two embodiments described, the electric cable 3 can also comprise a protective sheath arranged around the shielding 5 in order to protect the shielding 5. Indeed, certain shielding 5 sheaths can be fragile and easily damaged. The protective sheath also makes it possible to avoid short circuits between the shielding 5 and other neighboring static electrical elements. The protective sheath can for example be a braid of plastic wires such as PET (Polyethylene terephthalate) or PPS (Polyphenylene sulfide).

In this variant, the protective sheath is itself also wound around the connector housing 7 up to the level of the positioning means 21*a*, 21*b*. The holding ferrule 11 is placed around the protective sheath.

The connector 1 has the first connection area I and the second connection area II as described previously. However, in this variant, the holding ferrule 11 applies a pressure to the protective sheath which itself applies a pressure to the shielding 5 at the level of the first contact area I.

Similarly, when the connector 1 has the third connection area II (variant not represented), then the holding ferrule 11 applies a pressure to the protective sheath 41 which itself applies a pressure to the shielding 5.

Another subject of the invention is an assembly method making it possible to obtain a connector of shielded electric cables as previously described. This method is shown in diagram form in FIG. 7.

In a step E1 of positioning the shielding 5 represented by FIG. 2, the shielding 5 is wound around the connector housing 7 in such a way that the shielding 5 rests in abutment against the positioning means 21*a*, 21*b*.

In a step E2 of clamping the holding ferrule 11 represented by FIG. 8, the holding ferrule 11 as represented by FIG. 3 is wound around the shielding 5. The back end 7 being folded back, the back opening 33 of the ferrule is of small size with respect to the back face 8 of the connector housing 7. Thus, the back end 37 of the holding ferrule 11 rests in abutment against the back face 8 of the connector housing 7.

The holding ferrule 11 is drawn along the longitudinal axis X so as to clamp it around the shielding 5. This makes it possible to clamp the shielding 5 around the connector housing 7 all around the perimeter of the connector housing 7. Thus the first connection area I, represented by diagonal hatching, is formed, allowing a mechanical and electrical connection between the shielding 5 and the connector housing 7. The electrical continuity between the shielding 5 and the connector housing 7 is thus ensured.

The separate front ends 35*a* and 35*b* issuing from the large faces of the ferrule 23, 25 cover the positioning means 21*a*, 21*b*. The separate front ends 35*c*, 35*d* issuing from the small ferrule faces 27, 29 rest in abutment against the fastening means 19.

In a step E3 of crimping of the holding ferrule 11 as represented in FIG. 9, the separate front ends 35*a* and 35*b* of the holding ferrule 11 are crimped against the positioning means 21*a*, 21*b*. A second connection area II, represented in dotted lines, is thus formed allowing a mechanical connection between the holding ferrule 11 and the connector housing 7.

The crimping is represented by arrows 39.

During the crimping, the separate front ends 35*c*, 35*d* resting in abutment against the fastening means 19 make it possible to hold the holding ferrule 11 in the correct position and prevent unwanted deformations.

The crimping can for example be made with a blade making it possible to fold over the separate front ends 35*a* and 35*b* against the positioning means 21*a*, 21*b*.

In an optional step E4 of deep drawing the holding ferrule 11 represented by FIG. 10*a*, the holding ferrule 11 is deep drawn over the two large faces of the ferrule 23, 25. The third connection area III, represented by vertical hatching, is thus established allowing a mechanical and electrical connection between the shielding 5 and the connector housing 7. The electrical continuity between the shielding 5 and the connector housing 7 is thus reinforced.

This third connection area III is situated between the first connection area I and the second connection area II along the longitudinal axis X, and extends transversely over the two large faces of the ferrule 23, 25.

The deep drawing is represented by arrows 40.

The deep drawing can for example be carried out with a series of punches, of conical or spherical shape for example. In the variant where the connector housing 7 has openings 14, then the holding ferrule 11 is deep drawn into these openings 14, as represented by FIG. 10*b*.

The shielding 5 is drawn into the openings 14. The pressure exerted by the holding ferrule 11 on the shielding 5 at the level of the edge of the openings 14 and the connector housing 7 is great. The electrical and mechanical connection is improved as a consequence.

It will therefore be understood that by directly connecting the shielding 5 to the connector housing 7 configured to protect the conductors from electromagnetic disturbances, protection from electromagnetic disturbances is improved. Moreover, the number of parts required is reduced and a more compact and simplified connector 1 is obtained.

The first I, second II and third III connection area of the connector make it possible to ensure a good electrical continuity and mechanical resistance of the connector 1.

The method allowing the assembly of such a connector for a shielded electric cable is simple to implement.

The invention claimed is:

1. A connector for a shielded electric cable, the shielded electric cable including at least one conductor and a shielding that at least partly covers the shielded electric cable, the connector comprising:

a connector housing configured such that the conductor is arranged therein, and such that the shielding is partly arranged around said connector housing, said connector housing being electrically conductive; and a holding ferrule configured for being arranged around the shielding so as to hold the shielding in mechanical connection by clamping and in direct electrical connection with said connector housing, wherein said connector housing has a positioning and abutment means of the shielding around the connector housing and said holding ferrule has separate front ends folded back against said positioning and abutment means, so as to form a connection area allowing a mechanical connection between said holding ferrule and said connector housing.

2. The connector for a shielded electric cable as claimed in claim 1, wherein the holding ferrule has a back end capable of applying a pressure to the shielding in the direction of said connector housing as to allow a mechanical and electrical connection between the shielding and said connector housing over a connection area over the whole perimeter of the connector housing.

3. The connector for a shielded electric cable as claimed in claim 1, characterized in that said holding ferrule extends at least from the back face of said connector housing to said positioning and abutment means that it covers, so as to form two mechanical stops between said holding ferrule and the connector housing.

4. The connector for a shielded electric cable as claimed in claim 1, characterized in that said holding ferrule is deformed in the direction of said connector housing so as to form a connection area allowing a mechanical and electrical connection between the shielding and said connector housing.

5. The connector for a shielded electric cable as claimed in claim 1, said connector housing having a first face and a second face, said first and second faces having openings, characterized in that said holding ferrule is deep drawn in the direction of said connector housing at the level of the openings such that the shielding is partly drawn into the openings.

6. The connector for a shielded electric cable as claimed in claim 1, characterized in that it has a substantially rectangular cross section.

7. The connector for a shielded electric cable as claimed in claim 1, wherein the electric cable comprises a protective sheath arranged around the shielding, characterized in that said holding ferrule is arranged around said protective sheath so as to hold said protective sheath around the shielding around the outer surface of said connector housing so as to hold the shielding in mechanical connection by clamping and in direct electrical connection with the connector housing.

8. A method for assembling a connector for a shielded electric cable, the shielded electric cable including at least one conductor and a shielding that at least partly covers the shielded electric cable, the connector including a connector housing having positioning and abutment means and a holding ferrule having a back end and separate front ends, the method comprising:

winding the electrical shielding around the connector housing;

winding the holding ferrule around the shielding so as to clamp the back end of the holding ferrule around the shielding and thus to clamp the shielding around the connector housing so as to form a connection area, allowing an electrical and mechanical connection between the shielding and the connector housing; and crimping the front ends of the holding ferrule against the positioning and abutment means of the connector housing, so as to form a connection area allowing a mechanical connection between the holding ferrule and the connector housing.

9. The method for assembling a connector for a shielded electric cable as claimed in claim 8 further comprising:

drawing the holding ferrule in the direction of the connector housing so as to form a connection area, allowing an electrical and mechanical connection between the shielding and the connector housing.

10. The method for assembling a connector for a shielded electric cable as claimed in claim 9, the connector housing having openings, and wherein the method further comprises:

drawing the holding ferrule deep into the openings so as to partly draw the shielding into the openings so as to form the connection area allowing an electrical and mechanical connection between the shielding and the connector housing.

11. A connector comprising:

an electrically conductive connector housing configured such that a shielding may be partly arranged thereon, said electrically conductive connector housing comprising a positioning and abutment means of the shielding around the connector housing; and a holding ferrule coupled to said electrically conductive connector housing, said holding ferrule capable of clamping the shielding on said electrically conductive connector housing such that the shielding is in direct electrical connection with said electrically conductive connector housing, wherein said holding ferrule has separate front ends folded back against said positioning and abutment means, so as to form a connection area allowing a mechanical connection between said holding ferrule and said electrically conductive connector housing.

12. The connector of claim 11, wherein said holding ferrule has a back end configured to apply pressure to the shielding in the direction of said electrically conductive connector housing as to allow a mechanical and electrical connection between the shielding and said electrically conductive connector housing over a connection area over the whole perimeter of said electrically conductive connector housing.

13. The connector of claim 11, wherein said holding ferrule extends at least from a back face of the connector housing to said positioning and abutment means so as to form two mechanical stops between said holding ferrule and said electrically conductive connector housing.

14. The connector of claim 11, wherein said holding ferrule is deformed in a direction of said electrically conductive connector housing so as to form a connection area allowing a mechanical and electrical connection between the shielding and said electrically conductive connector housing.

15. The connector of claim 11, wherein:

said electrically conductive connector housing having a first face and a second face, with the first and second faces having openings; and said holding ferrule is disposed in the direction of said electrically conductive connector housing at the level of the openings such that the shielding is partly drawn into the openings.

16. The connector of claim 11, wherein the connector has a substantially rectangular cross section.

17. The connector of claim 11, further comprising a shielded electric cable comprising:

at least one conductor;

a shielding that at least partly covers said at least one conductor;

a protective sheath arranged around said shielding and wherein said holding ferrule is arranged around said protective sheath so as to hold said protective sheath around the shielding around the outer surface of said electrically conductive connector housing so as to hold said shielding in mechanical connection by clamping and in direct electrical connection with said electrically conductive connector housing.

18. A connector for a shielded electric cable, the shielded electric cable including at least one conductor and a shielding that at least partly covers the shielded electric cable, the connector comprising:

a connector housing configured such that the conductor is arranged therein, and such that the shielding is partly arranged around said connector housing, said connector housing being electrically conductive; and a holding ferrule configured for being arranged around the shielding so as to hold the shielding in mechanical connection by clamping and in direct electrical connection with said connector housing, wherein said connector housing has a positioning and abutment means of the shielding around the connector housing and said holding ferrule has separate front ends folded back against said positioning and abutment means, so as to form a connection area allowing a mechanical connection between said holding ferrule and said connector housing, and wherein said holding ferrule extends at least from the back face of said connector housing to said positioning and abutment means that it covers, so as to form two mechanical stops between said holding ferrule and the connector housing.

19. A method for assembling a connector for a shielded electric cable, the shielded electric cable including at least one conductor and a shielding that at least partly covers the shielded electric cable, the connector including a connector housing having positioning and abutment means and openings, and a holding ferrule having a back end and separate front ends, the method comprising:

winding the electrical shielding around the connector housing;

winding the holding ferrule around the shielding so as to clamp the back end of the holding ferrule around the shielding and thus to clamp the shielding around the connector housing so as to form a connection area, allowing an electrical and mechanical connection between the shielding and the connector housing;

crimping the front ends of the holding ferrule against the positioning and abutment means of the connector housing, so as to form a connection area allowing a mechanical connection between the holding ferrule and the connector housing, drawing the holding ferrule in the direction of the connector housing; and drawing the holding ferrule deep into the openings of the connector housing so as to partly draw the shielding into the openings so as to form the connection area, allowing an electrical and mechanical connection between the shielding and the connector housing.

* * * * *